US007547190B1

(12) United States Patent
Liang

(10) Patent No.: US 7,547,190 B1
(45) Date of Patent: Jun. 16, 2009

(54) TURBINE AIRFOIL SERPENTINE FLOW CIRCUIT WITH A BUILT-IN PRESSURE REGULATOR

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 409 days.

(21) Appl. No.: 11/486,695

(22) Filed: Jul. 14, 2006

(51) Int. Cl.
*F01D 5/08* (2006.01)

(52) U.S. Cl. ..... 416/97 R

(58) Field of Classification Search ..... 416/97 R
See application file for complete search history.

(56) References Cited

U.S. PATENT DOCUMENTS

| | | | | |
|---|---|---|---|---|
| 2,977,089 | A | 3/1961 | McCarty et al. | |
| 2,977,090 | A | 3/1961 | McCarty et al. | |
| 3,706,508 | A | 12/1972 | Moskowitz et al. | |
| 3,791,758 | A | 2/1974 | Jenkinson | |
| 4,236,870 | A | 12/1980 | Hucul, Jr. et al. | |
| 4,257,737 | A | 3/1981 | Andress et al. | |
| 4,330,235 | A * | 5/1982 | Araki | 416/97 R |
| 4,626,169 | A | 12/1986 | Hsing et al. | |
| 5,073,086 | A * | 12/1991 | Cooper | 416/97 R |
| 5,403,156 | A | 4/1995 | Arness et al. | |
| 6,186,741 | B1 | 2/2001 | Webb et al. | |
| 6,234,753 | B1 * | 5/2001 | Lee | 416/97 R |
| 6,485,255 | B1 | 11/2002 | Care et al. | |
| 6,491,496 | B2 | 12/2002 | Sarkweather | |
| 6,634,858 | B2 | 10/2003 | Roeloffs et al. | |
| 7,431,562 | B2 * | 10/2008 | Hooper et al. | 416/97 R |
| 2007/0189897 | A1 * | 8/2007 | Pietraszkiewicz et al. | 416/97 R |

* cited by examiner

*Primary Examiner*—Richard Edgar
(74) *Attorney, Agent, or Firm*—John Ryznic

(57) ABSTRACT

An airfoil for used in a gas turbine engine, the airfoil having a serpentine cooling flow circuit formed within the airfoil to provide cooling for the leading edge and trailing edge of the airfoil. A first leg of the serpentine circuit supplies cooling air to a leading edge cooling channel and a showerhead arrangement. A second and third leg of the serpentine circuit carries cooling air not bled off to the leading edge toward the trailing edge of the airfoil for cooling. Located between the second leg and the third leg is a cavity in which cooling air flows. A convergent nozzle is formed on the second leg opening into the cavity, with a divergent nozzle formed on the third leg also opening into the cavity. The two nozzles provide a way to regulate the flow rate through the serpentine circuit in order that a higher pressure is available for the leading edge cooling, and a lower pressure is available for the trailing edge cooling. Also, the nozzles are located in the cavity such that a tool can be inserted into the cavity to change the nozzle size, and therefore regulate the flow rate and pressures within the serpentine cooling flow circuit.

16 Claims, 1 Drawing Sheet

TURBINE AIRFOIL SERPENTINE FLOW CIRCUIT WITH A BUILT-IN PRESSURE REGULATOR

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

1. Field of the Invention

The present invention relates generally to fluid reaction surfaces, and more specifically to internally cooled airfoils used in a gas turbine engine.

2. Description of the Related Art Including Information Disclosed Under 37 CFR 1.97 and 1.98

A gas turbine engine, such as an aero engine or an industrial turbine engine, use turbine blades to convert energy from a hot gas stream into mechanical energy through rotation of a shaft connected to the blades. Because the efficiency of the engine increases with an increase in the hot gas stream temperature, higher efficiencies are obtained by providing internal cooling for the turbine airfoils such as the stationary vanes or the rotating blades.

A typical turbine blade will include a somewhat complex arrangement of cooling passages within the blade to maximize the cooling effect of the cooling air passing through the blade. A 3-pass serpentine flow circuit is a typical prior art cooling flow circuit used in turbine blades because it increases the cooling effectiveness by extending the length of the coolant flow path. In this circuit, a first leg supplies cooling air to a leading edge cooling channel which provides cooling air to a shower head arrangement for cooling the leading edge of the blade. Cooling air from the first leg that does not flow into the leading edge cooling channel passes into the second and third legs of the serpentine flow path, and then onward toward the trailing edge cooling holes that discharge out from the blade to cool the trailing edge.

The leading edge of the airfoil is exposed to the highest temperature and pressure acting on the airfoil. The forward region of the airfoil pressure surface is exposed to pressure from the hot gas that is slightly lower in pressure than is exposed on the leading edge. Because of this pressure difference, the cooling air flowing in the leading edge portion of the blade must be at a high enough pressure to provide back flow margin (BFM) in which the hot gas has a higher pressure than the leading edge cooling air and flows into the blade. U.S. Pat. No. 4,257,737 issued to Andress et al on Mar. 24, 1981 and entitled COOLED ROTOR BLADE shows this type of cooling arrangement. Cooling air enters a serpentine passageway at the blade root and flows into a first leg. A portion of the cooling air in the first leg flows through metering holes (28 in FIG. 1 of this patent) and into recessed portions (14 in FIG. 1 of this patent) before discharging through cooling holes 30 to cool the leading edge of the blade. Cooling air not diverted from the first leg continues on into the second and third legs of the serpentine flow circuit, and is discharged through cooling holes out the trailing edge of the blade. In the Andress et al prior art invention, the cooling air pressure in the first leg must be high enough to prevent backflow of the hot gas stream acting on the trailing edge. Because the cooling air pressure in the first leg is high, and because the second and third legs are in direct fluid communication with the first leg, most of the cooling air entering the first leg will flow into the second leg and this high pressure. More cooling air flows toward the trailing edge than is needed to adequately cool the trailing edge side of the blade. Therefore, in the Andress et al invention, an excess amount of cooling air is used in order to provide adequate leading edge cooling of the blade.

The prior art patent U.S. Pat. No. 6,491,496 issued to Starkweather on Dec. 10, 2002 and entitled TURBINE AIRFOIL WITH METERING PLATES FOR REFRESHER HOLES advances the cooling flow circuit of the above Andress et al patent by providing two serpentine cooling circuit, one for the leading edge and a second for the trailing edge. However, in the Starkweather patent, the pressure of the cooling air entering the leading edge serpentine circuit is the same as the pressure entering the trailing edge serpentine circuit. Because less cooling air flow is needed to cool the trailing edge, and because both pressures are the same, more cooling air flows into the trailing edge circuit than is needed.

Prior Art patent U.S. Pat. No. 5,403,156 issued to Arness et al on Apr. 4, 1995 and entitled INTEGRAL METER PLATE FOR TURBINE BLADE AND METHOD shows a turbine blade with a meter plate formed from a depending member extending from the root of the turbine blade just short of the edge of the bottom of the broach in the disk in the live rim area is cast integrally with the blade and serves to meter coolant flow from the on board injector to internally of the blade. The final dimension can be configured in the machining operation of the blade to attain the desired amount of coolant flow for internal blade cooling. In this patent, the metering device is not located in the serpentine flow circuit of the blade. Also, the metering device in this patent cannot be used to control the air flow volume to the leading edge portion of the blade. The metering device cannot be used to regulate the serpentine flow cooling flow circuit back flow margin (BFM) for the leading edge showerhead region and the out flow margin (OFM) for the second leg of the down-pass as well as the cooling flow pressure and flow rate to the trailing edge.

Another prior art patent, U.S. Pat. No. 6,186,741 B1 issued to Webb et al on Feb. 13, 2001 and entitled AIRFOIL COMPONENT HAVING INTERNAL COOLING AND METHOD OF COOLING, shows a turbine blade having a leading edge and a trailing edge, shows a turbine blade with a serpentine cooling flow circuit within the blade. The blade includes a leading edge cooling passageway (128 in this patent), a trailing edge cooling passageway (132 in this patent), and a serpentine cooling circuit between the LE and TE passageways having a 5-pass circuit. A core tie hole fluidly connected adjacent cooling passageways such that cooling air flowing into the leading edge cooling passageway can flow into the trailing edge cooling passageway. This patent also includes a metering plate having a metering hole therein located at the entrance to the trailing edge cooling passageway for the purpose of lowering the pressure of the cooling air in the trailing edge cooling passageway to the point where the pressure in the adjacent $5^{th}$ leg of the serpentine cooling circuit is about equal. In the Webb et al patent, one problem is that the core tie holes cannot be changed after the blade has been cast, and therefore the cooling flow through the various circuits cannot be adjusted depending upon the operating conditions of the blade.

It is therefore an object of the present invention to provide for an improved serpentine circuit cooling flow through a turbine airfoil such that adequate cooling air pressure to the hot region of the airfoil is obtained and without over-pressuring the trailing edge region of the airfoil.

It is another object of the present invention to provide for a turbine airfoil with a metering device that can be formed into the airfoil during casting, and that can be changed easily before installation into the turbine.

BRIEF SUMMARY OF THE INVENTION

The present invention is an airfoil having a serpentine cooling flow circuit formed within the airfoil body, where a first leg of a 3-pass serpentine cooling flow circuit provides backside impingement cooling for the airfoil leading edge. Cooling air is bled off from the first up-pass of the flow channel, impinging onto the backside of the airfoil leading edge, thus providing backside impingement convective cooling for the airfoil leading edge region. Subsequently, the spent cooling air is discharged through the leading edge showerhead cooling holes to form a protective film layer, thus reducing the leading edge heat load. Triple impingement cooling in conjunction with slot exit flow is used for the airfoil trailing edge cooling. Cooling air is fed through the third leg of the serpentine up-pass radial channel, and then impinges onto the first, second and third ribs, then impinges against the trailing edge exit slot rib. Finally, the cooling air is discharged through the trailing edge slots. In addition, a convergent nozzle cooling flow metering device is formed integral at the exit of the second leg of the serpentine pass and a divergent nozzle cooling flow metering device is formed integral at the entrance of the third leg of the serpentine pass. These metering devices are used to regulate the serpentine flow cooling flow circuit back flow margin (BFM) for the leading edge showerhead region and the out flow margin (OFM) for the second leg of the down-pass as well as the cooling flow pressure and flow rate to the trailing edge. Both metering devices can be adjusted independently and easily after the blade has been cast.

DETAILED DESCRIPTION OF THE INVENTION

Figure 1:
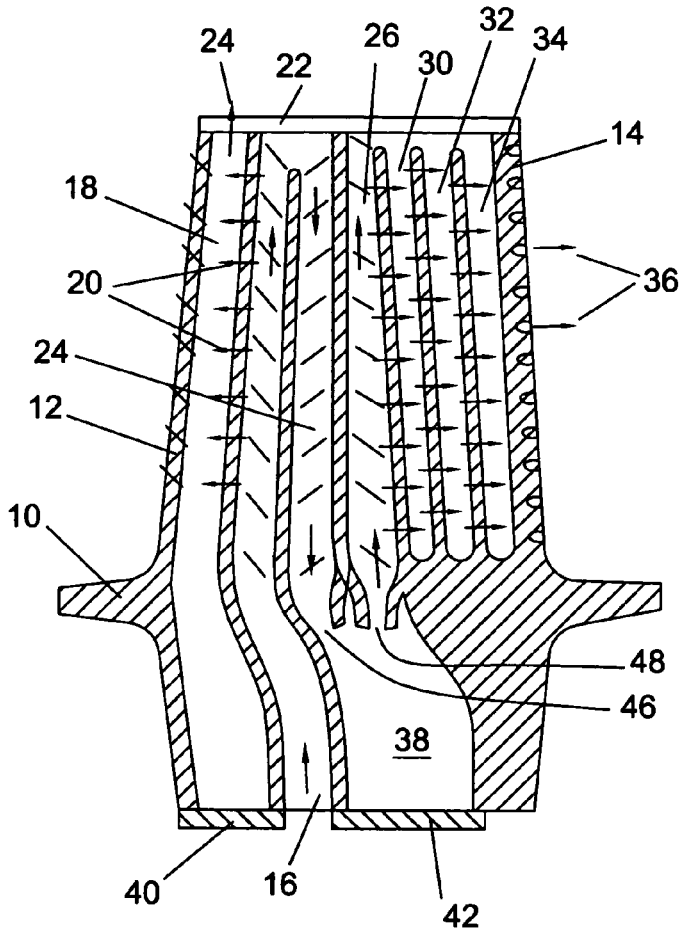
FIG. 1 shows a cross section view of the serpentine cooling flow circuit of the present invention.

The present invention is an air cooled airfoil such as a rotary blade or a stationary vane for use in a gas turbine engine. FIG. 1 shows a cross section of the blade version, in which a blade 10 includes a leading edge 12 and a trailing edge 14, and an internal cavity with a serpentine cooling flow circuit formed therein. A cooling air inlet 16 forms the first leg of the serpentine flow circuit, with the second leg 24 and the third leg 26 in series. A leading edge cooling channel 18 is positioned between the first leg 16 and the leading edge and received cooling air from the first leg 16 through a plurality of metering holes 20, a cover plate 40 forms a closed channel in the blade. The leading edge cooling channel 18 discharges cooling air to the leading edge through a showerhead configuration. The leading edge cooling channel is shown as a single channel extending from the root to the tip of the blade. However, other embodiments can be used such as a plurality of separate channels each having one or more metering holes to supply air from the first leg 16.

Cooling air in the first leg 16 that is not diverted into the metering holes 20 passes into the second leg 24 of the serpentine flow circuit. A cavity 38 is located between the second leg 24 and the third leg 26. A cover plate 42 covers the opening to the blade to form the cavity 38. Cooling air from the third leg 26 flows into a plurality of radially extending cooling passages 30, 32, and 34 through metering holes formed in the ribs that forms the radial extending cooling passages (30, 32, 34) and out holes on the trailing edge 14 of the blade.

A convergent nozzle 46 is formed in the exit end of the second leg 24 of the serpentine flow circuit and opens into the cavity 38. The convergent nozzle 46 provides a back pressure to the cooling air flow upstream from that location. This maintains a proper high pressure upstream such that an adequate amount of cooling air is bled off through the metering holes and into the leading edge cooling channel 18. A divergent nozzle 48 is formed in the entrance end of the third leg 26 and functions to control the cooling flow pressure and flow rate to the trailing edge of the blade.

Figure 2:
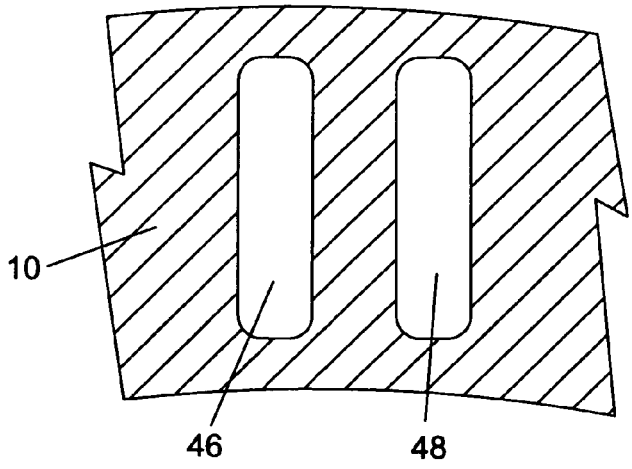
FIG. 2 shows a cut-away view of the metering devices used in the serpentine cooling flow circuit of the present invention.

The convergent nozzle 46 and the divergent nozzle 48 that form the metering devices are used to regulate the serpentine flow cooling flow circuit back flow margin (BFM) for the leading edge showerhead region and the out flow margin (OFM) for the second leg of the down-pass as well as the cooling flow pressure and flow rate to the trailing edge. Both metering devices can be adjusted independently and easily after the blade has been cast. FIG. 2 shows a cut-away view of a section of the blade in which the two nozzles are shown. The nozzles are wider in the direction from blade pressure side to suction side than in the direction along the blade cord. The nozzles are cast into the blade when the blade is formed. One of the features of the present invention is that the nozzles are located near to the opening covered by the cover plate 42. With the cover plate 42 removed, an operator can insert a tool and remove material to one or both of the nozzles in order to change the size of the nozzle. The blade cooling flow amount can therefore be accurately controlled by measuring flows rates and adjusting the nozzle size until a proper amount of cooling air flow to the leading edge and the training edge of the blade is obtained.

The present invention therefore provides for a turbine airfoil such as a blade or a vane that can be cast with the flow regulating features also formed within the blade or vane, and in which the flow regulating features can be varied to adjust for flow rates depending upon external blade or vane conditions without having to damage the blade.

I claim the following:

1. An airfoil for use in a gas turbine engine, the airfoil comprising:

an internal serpentine cooling flow circuit having a first leg, a second leg downstream from the first leg, and a third leg downstream from the second leg;

a cavity formed within the airfoil and located between the second leg and the third leg;

a plurality of leading edge cooling holes in fluid communication with the first leg;

a plurality of trailing edge cooling holes in fluid communication with the third leg; and, a convergent nozzle on the end of the second leg and opening into the cavity.

2. The airfoil of claim 1, and further comprising:

a divergent nozzle on the entrance of the third nozzle and opening into the cavity.

3. The airfoil of claim 2, and further comprising:

the convergent nozzle and the divergent nozzle both have an opening with a width from pressure side to suction side greater than the width in the airfoil chordwise direction.

4. The airfoil of claim 2, and further comprising:

the convergent nozzle and the divergent nozzle are both cast into the airfoil during an airfoil casting process.

5. The airfoil of claim 1, and further comprising:

a cover plate to cover the cavity; and, the convergent nozzle being located near to the cavity such that the nozzle size can be changed by a tool inserted into the cavity.

6. The airfoil of claim 1, and further comprising:

a leading edge cooling channel located between the leading edge of the airfoil and the first leg of the serpentine flow circuit; and, a plurality of metering holes to fluidly connect the first leg to the leading edge cooling channel.

7. The airfoil of claim 1, and further comprising:

a plurality of radial extending cooling passages located between the third leg of the serpentine cooling circuit and the trailing edge to provide a fluid communication between the third leg and the cooling holes on the trailing edge of the airfoil.

8. The airfoil of claim 1, and further comprising:

the airfoil is a turbine rotor blade.

9. The airfoil of claim 1, and further comprising:

the convergent nozzle has an opening with a width from pressure side to suction side greater than the width in the airfoil chordwise direction.

10. The airfoil of claim 1, and further comprising:

the convergent nozzle is cast into the airfoil during an airfoil casting process.

11. In an airfoil used in a gas turbine engine, the airfoil having a leading edge and a trailing edge, and a serpentine cooling flow circuit formed within the airfoil, a process for regulating the flow rate through the serpentine circuit comprising the steps of:

forming the serpentine cooling flow circuit in the airfoil with a cavity formed within the airfoil and located between a second leg and a third leg of the serpentine cooling flow circuit, the cavity opening into the root end of the airfoil;

forming a convergent nozzle on the exit of the second leg and opening into the cavity; and, inserting a tool into the cavity and changing the size of the opening in the convergent nozzle in order to regulate the cooling air flow through the serpentine cooling flow circuit.

12. The process for regulating the flow rate through the serpentine circuit of claim 11, and further comprising the steps of:

forming a divergent nozzle on the end of the third leg of the serpentine circuit and opening into the cavity; and, inserting a tool into the cavity and changing the size of the opening in the divergent nozzle in order to regulate the cooling air flow through the serpentine cooling flow circuit.

13. The process for regulating the flow rate through the serpentine circuit of claim 11, and further comprising the steps of:

forming a showerhead arrangement on the leading edge of the airfoil and in fluid communication with the first leg to provide cooling air to the leading edge of the airfoil.

14. The process for regulating the flow rate through the serpentine circuit of claim 13, and further comprising the step of:

forming a plurality of radial extending cooling passages in the airfoil located between a third leg and the trailing edge cooling holes to provide cooling air to the trailing edge of the airfoil.

15. The process for regulating the flow rate through the serpentine circuit of claim 13, and further comprising the step of:

forming a leading edge cooling channel in the airfoil between the showerhead arrangement and the first leg to provide impingement cooling on the cooling channel.

16. The process for regulating the flow rate through the serpentine circuit of claim 11, and further comprising the step of:

placing a cover plate over the cavity to form a closed space within the airfoil.

* * * * *